United States Patent [19]

Moss

[11] 3,961,321

[45] June 1, 1976

[54] OMNIDIRECTIONAL ULTRASONIC INTRUSION SURVEILLANCE UNIT

[76] Inventor: Royston Arthur Leslie Moss, "Fishpools", Werrington., Peterborough, England

[22] Filed: Jan. 24, 1975

[21] Appl. No.: 543,821

Related U.S. Application Data

[63] Continuation-in-part of Ser. No. 397,853, Sept. 17, 1973, abandoned.

[52] U.S. Cl. ..... 340/258 B; 340/276; 343/5 PD

[51] Int. Cl.[2] ..... G08B 13/16

[58] Field of Search ..... 340/258 B, 258 A, 258 R; 343/7.7, 5 PD, 6 R

[56] References Cited

UNITED STATES PATENTS

| | | | |
|---|---|---|---|
| 3,691,556 | 9/1972 | Bloice | 340/258 B |
| 3,727,216 | 4/1973 | Antonio | 343/6 R |
| 3,793,617 | 2/1974 | Tolman | 340/258 A |

*Primary Examiner*—Glen R. Swann III
*Attorney, Agent, or Firm*—Ladas, Parry, Von Gehr, Goldsmith & Deschamps

[57] ABSTRACT

An omnidirectional ultrasonic intrusion surveillance unit can be suspended or supported in a room or like closed environment so that there is space substantially all round the unit, permitting surveillance all around the unit, that is, over substantially $4\pi$ steradians, simultaneously. Ultrasonic waves are generated by an oscillator and radiated via an arrangement of transducers in a plurality of directions in the space surrounding the unit. The reflected waves are received from substantially all directions in the space by a transducer system associated with the wave radiating transducers, and a detector is provided to sense variations in the received reflected waves. Amplified signals produced by the detector in response to any such variations are applied to a trigger unit having a predetermined reference level indicative of intrusion disturbance of the wave field, and an external alarm is placed in operative condition if the level is exceeded.

7 Claims, 7 Drawing Figures

STANDBY CIRCUITS OF THE
SIGNAL PROCESSING STAGE

AMPS FAILURE DETECTOR 17
STANDBY COUNTER 18
STANDBY GATING AND RELAY DRIVE 20
RESET TIMER 19
AMP. 9
AMP. 10
AMP. 11
AMP. 12
TO RELAY RLA FIG. 6
TO FIG. 4
T13
T14
T16
+VCC
-VCC
0V

OMNIDIRECTIONAL ULTRASONIC INTRUSION SURVEILLANCE UNIT

CROSS-REFERENCES TO RELATED APPLICATION

This application is a continuation-in-part of my earlier copending application Ser. No. 397,853 filed Sept. 17, 1973 now abandoned.

BACKGROUND OF THE INVENTION

1 Field of the Invention

This invention relates to omnidirectional ultrasonic intrusion surveillance unit.

2. Description of the Prior Art

Such surveillance units at the present time are bulky, requiring three monthly maintenance, expensive and are of a sensitive nature giving rise to "False Alarms". They operate either by use of single transducer heads in separate instruments reacting upon each other, or with two heads within one instrument. The field covered by such an instrument is limited to the area forward of the transducer head usually in the order of 160° in two planes. Such an instrument can easily be attacked and neutralized by a determined intruder.

SUMMARY OF THE INVENTION

According to the invention there is provided an omnidirectional ultrasonic surveillance unit for use in a closed environment and comprising:

a substantially closed shell forming a housing;

means for supporting the housing away from any ceiling, walls and floor of the closed environment so that there is open space substantially all around the housing;

means for radiating oscillatory energy at an ultrasonic frequency in substantially all directions from said surveillance unit so that the open space all around the housing is filled with sound waves;

said housing being adapted to vibrate in response to reflected sound waves impinging thereon;

receiver transducer means connected to the inside of said housing for sensing vibration thereof and for generating an oscillatory electrical signal in response thereto; and electrical circuitry inside the housing, said electrical circuitry including:

means for generating said oscillatory energy inside the housing and for driving said radiating means;

means for amplifying the oscillatory electrical signal generated by said receiver transducer means;

discriminator means for producing a variable DC signal responsive to amplitude variations in the amplified oscillatory electrical signal from the amplifying means;

low frequency amplifier means for amplifying low frequency signals from said discriminator means; and means responsive to the output from said low frequency amplifier means for producing an electrical alarm-operating signal.

A preferred intrusion surveillance unit in accordance with the invention is a unit of relatively compact dimensions, relatively inexpensive and readily adaptable to environment, which surveys continuously and simultaneously all the space around the unit, that is, substantially $4\pi$ steradians solid angle, and which is stationary. (One steradian is the solid angle subtended at the centre of a sphere of radius r by an area of $r^2$ at the surface of the sphere, of which the total surface area is $4\pi r^2$. Hence $4\pi$ steradians is all directions from the sphere). The criteria being followed is that even if an intruder were fully aware of the instrument's existence and operation he would still be unable to neutralize the operation of the instrument without first triggering the alarm system. The instrument is set so that minor disturbances, such as small rodents, would not trigger the alarm system nor would vibrations set up, for instance, by passing traffic either in the solid state of the protected area or again, for instance, passed through windows set in the protected area. The instrument is of such a nature so as not to operate if itself is subject to reasonable vibration or shaking; the instrument is stable within a wide temperature range, and not liable to operate in the event of a power surge in the electrical supply to the unit. Further, the instrument is designed with a minimum maintenance factor. The instrument is designed not only for use in high risk situations but also for simple operation in the domestic field with means to adjust sensitivity. The instrument may also be used as a fire alarm, at the same time as an intrusion surveillance unit. When the instrument operates as a fire alarm, a fire may be detected by the movement of air due to convection currents caused by the heat.

In one embodiment of this invention a plurality of receiving transducer heads are directed in different directions so that together they cover all directions, i.e. substantially $4\pi$ steradians. For example, the surveillance unit may comprise a spherical metal shell having around its perimeter four port-holes, through which four transmitting transducers emit sonar waves which fill the enclosed room with sound waves, reflected at various angles in the room, causing the shell to vibrate. The shell has a strain gauge transducer fixed to the inside thereof to sense the shell vibrations.

In alternative forms of embodiment, the shell may have a different number of ports and transmitter transducers, possibly even only one, or may have one or more pointed or domed transmitter transducers projecting from the shell.

There follows a description of a preferred embodiment of the invention by way of example with reference to the accompanying drawings.

DESCRIPTION OF THE PREFERRED EMBODIMENT

Figure 1:
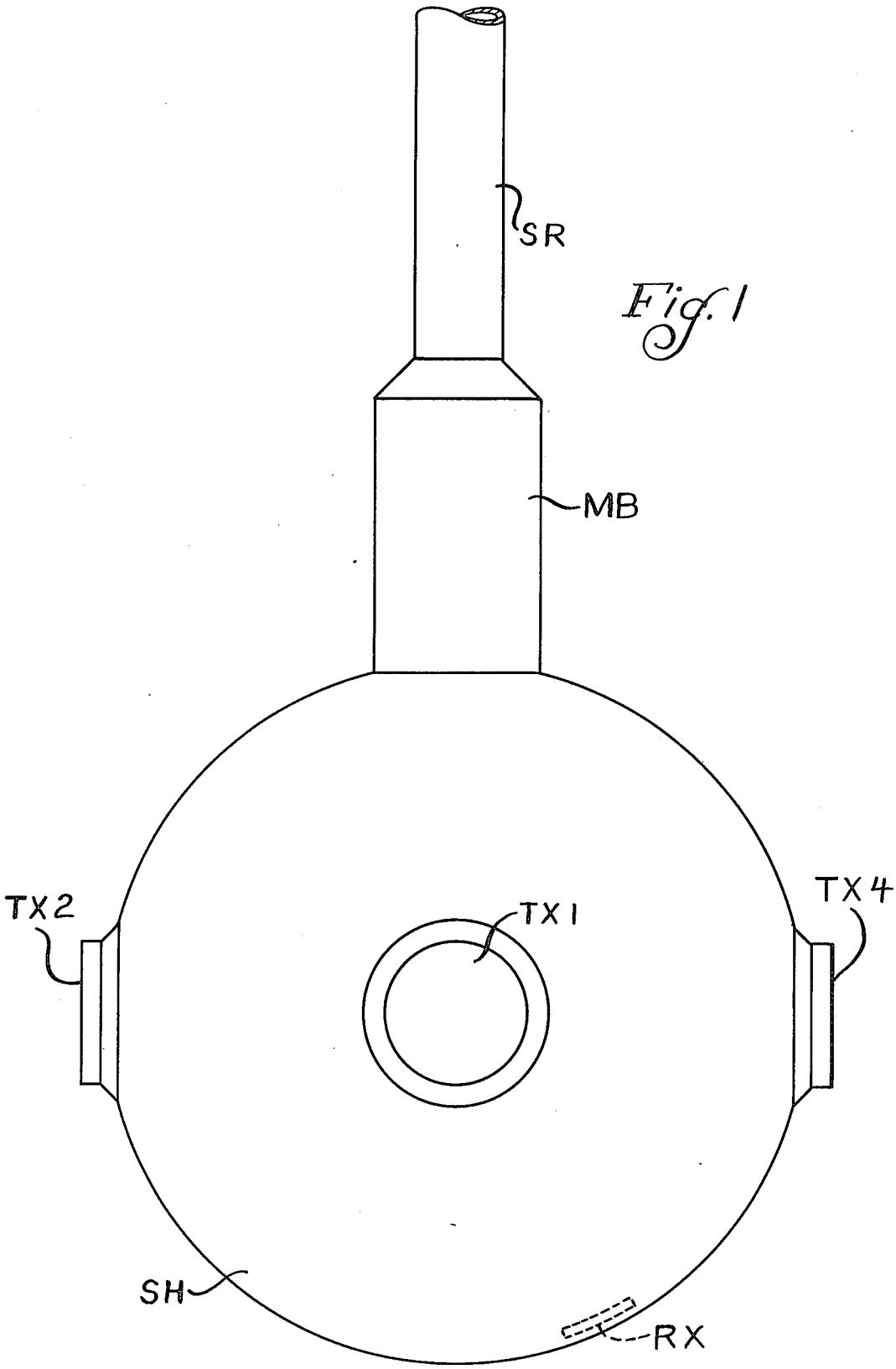
FIG. 1 is a front elevation of an omnidirectional ultrasonic surveillance unit.

Referring to FIG. 1 of the drawings,, the illustrated omnidirectional ultrasonic unit comprises a housing in the form of a substantially spherical closed metal shell SH, joined to and suspended from a suspension rod SR. The alarm also comprises four transmitting transducer heads TX1 through TX4, (see also FIG. 3), arranged in four equidistant port-holes around the middle of the shell SH. The four transducers are conventional sonar transducers with flat diaphragms.

When the unit is in a room or other closed environment, suspended by the rod SR, and the four transducers are driven in an oscillatory manner, substantially the entire space around the unit is filled with sound waves, causing the shell to vibrate. Hence the shell itself can be used as part of a receiving transducer RX1, (see also FIG. 4,) comprising an electrical strain gauge resistance fixed conventionally to the inside of the shell SH. The shell SH is initially formed as two metal hemispheres which are eventually welded or otherwise joined together along a diametral plane (not illustrated) which is sloped so as not to pass through any of the transducers TX1 through TX4 and so as not to pass through the place where the rod SR adjoins the shell SH. Instead of being spherical, shell SH may be ovoid or elliptoidal, for example. The rod SR is elongate and thin (relative to the diameter of the shell SH) and serves to support the shell SH so that the shell SH is held well away from ceiling, floor and walls of a room or other closed environment, with open space all around the shell SH except where the rod SR is. All the circuitry illustrated in FIGS. 2 to 6 is housed inside the shell SH, except for an alarm. Power to the unit is via the rod SR, connected by a conduit (not shown) to conventional switchgear for switching the unit on and off, with a "test" position and an "operational" position. The surveillance unit is operational in both the test and operational positions, but the alarm itself, which is remote from the surveillance unit, is switched off in the test position, a separate indicator being used to show that the surveillance unit produces the alarm-operating signal in response to a disturbance.

Figure 2:
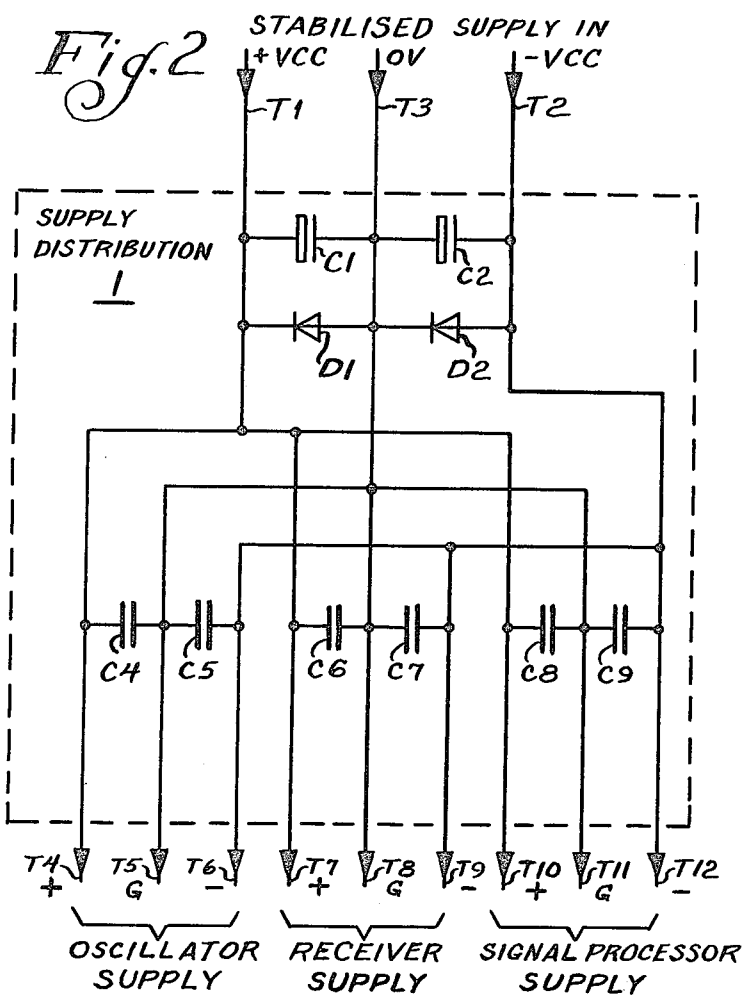
FIG. 2 is a circuit diagram of an electrical supply distribution network 1 in the surveillance unit of FIG. 1.
Figure 5:
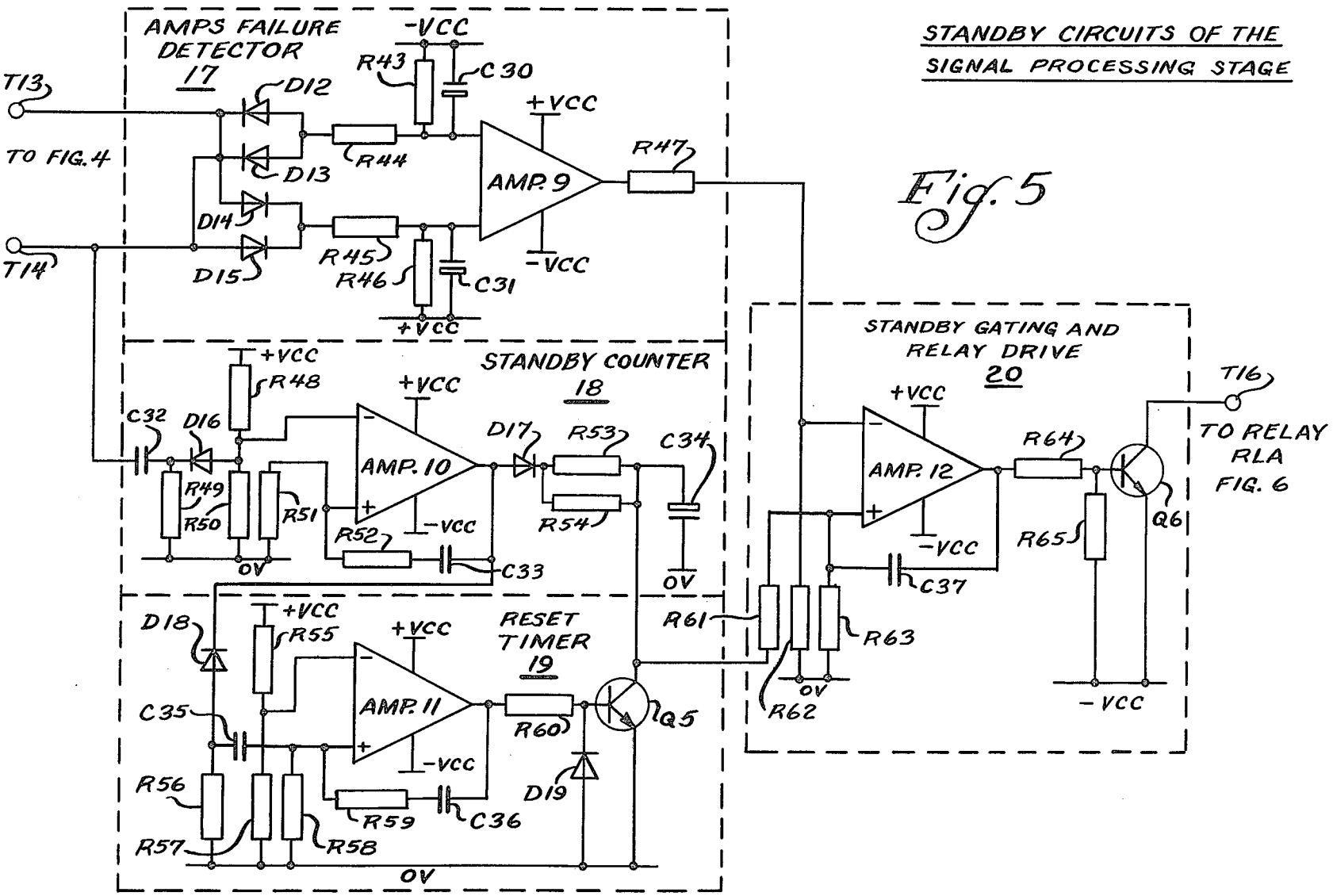
Figure 6:
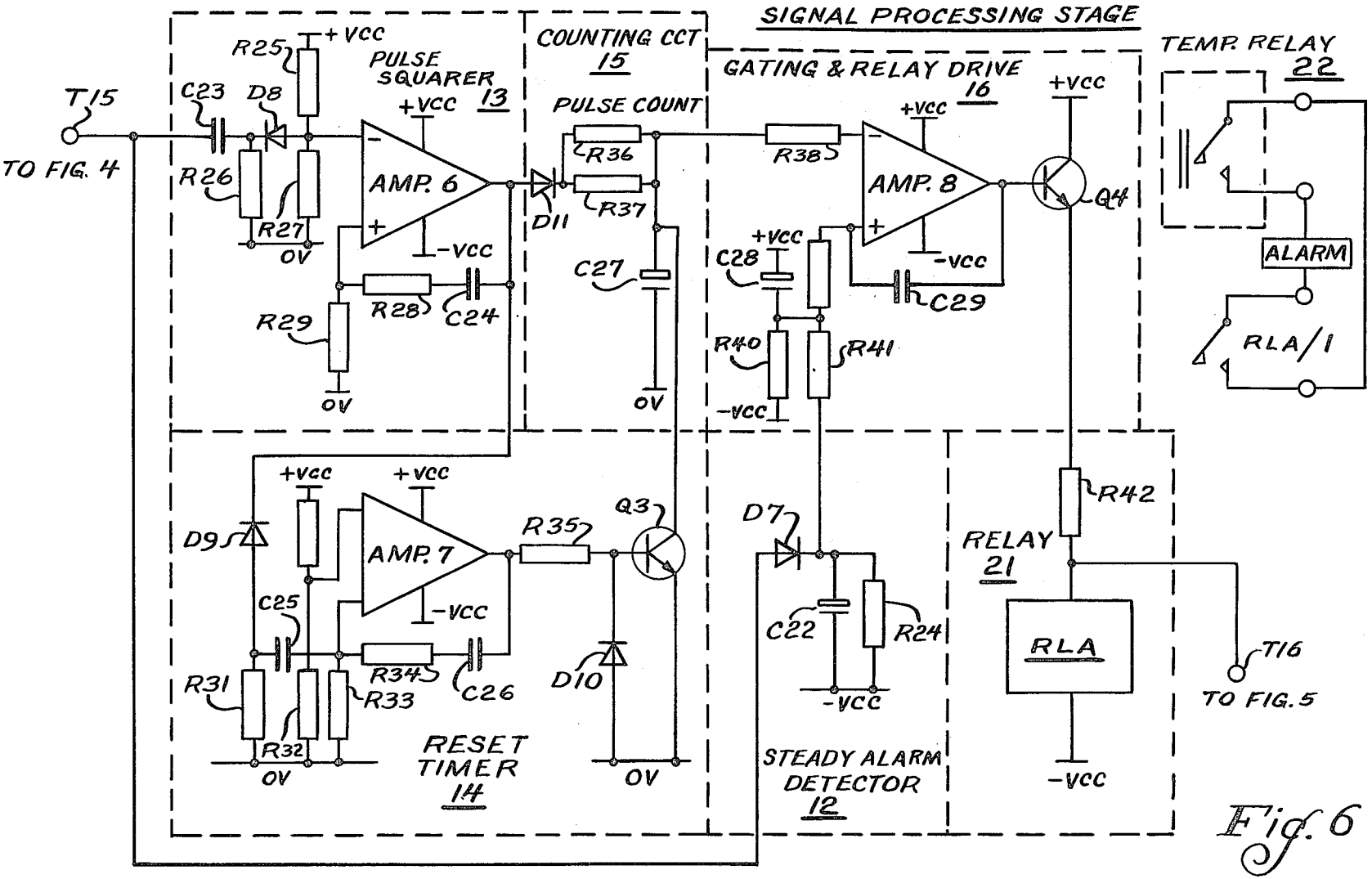

Referring to FIG. 2, stabilised positive and negative voltage at +12 volts and −12 volts is supplied to the supply distribution network 1 at terminals T1 and T2 respectively, relative to an earth potential terminal T3. Reservoir capacitors C1 and C2 and reverse polarity protection diodes D1 and D2 are connected across terminals T1 and T3 and across terminals T2 and T3 respectively as shown. There are nine output terminals T4 to T12 from supply distribution unit 1. Terminals T4, T7 and T10 are connected to T1 for positive voltage $+V_{cc}$; terminals T5, T8 and T11 are connected to T3 at earth potential
($O_v$); whilst termnals T6, T9 and T12 are connected to T2 for negative voltage $-V_{cc}$. Terminals T4 to T6 supply the transmitter 1 (FIG. 3), terminals T7 to T9 the receiver stage (FIG. 4) and terminals T10 to T12 the signal processing stage (FIGS. 5 and 6). Capacitors C4 through C9 are connected as shown to provide independent filtering of the three supply outputs of the supply distribution network 1.

Figure 3:
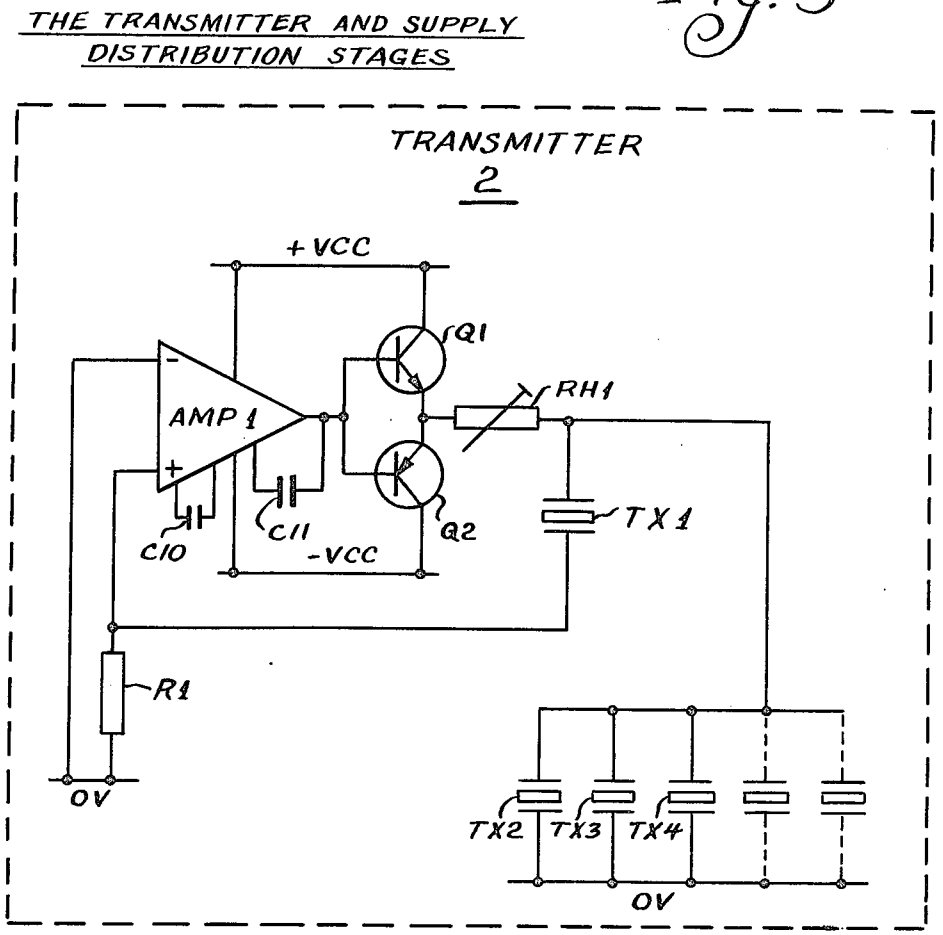
FIG. 3 is a circuit diagram of a transmitter 2 in the surveillance unit of FIG. 1.

Referring to FIG. 3, the transmitter 2 comprises an integrated circuit (IC) amplifier AMP 1, an NPN-type transistor Q1, a PNP-type transistor Q2, resistance R1, rheostat RH1, capacitors C10 and C11 and the aforementioned sonar transducers TX1 through TX4, interconnected and supplied with $+V_{cc}$, $-V_{cc}$ and Ov, as shown in FIG. 3, from network 1 (FIG. 2). The transmitter 2 components form a multivibrator which oscillates at substantially the resonant frequency of transducer TX1, the latter providing positive feedback to AMPI. Transducers TX2, TX3 and TX4 are driven by the multivibrator at its oscillation frequency.

Figure 4:
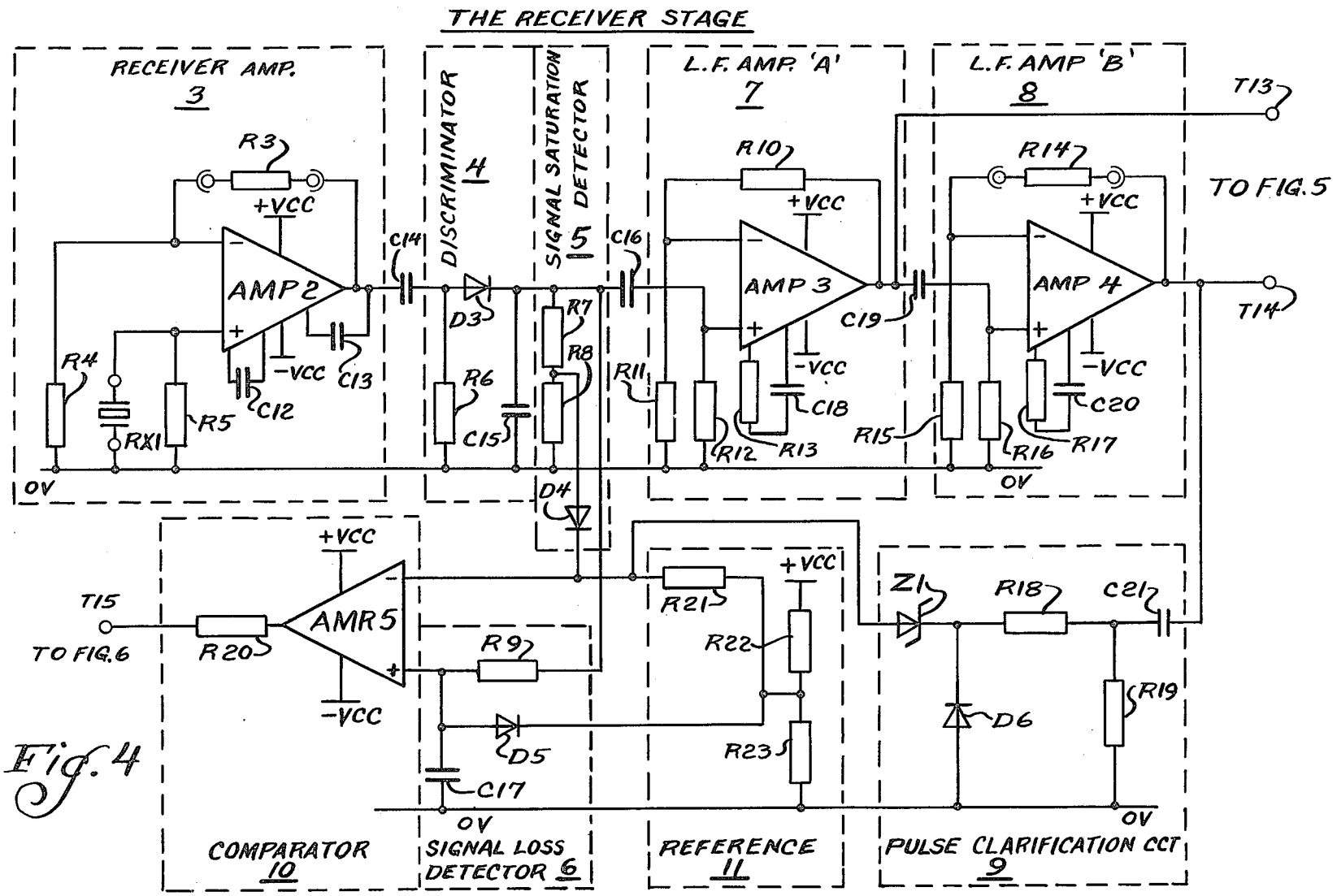
FIGS. 4, 5 and 6 in combination are a circuit diagram of a receiver stage and signal processing stage in the surveillance unit of FIG. 1.

Referring to FIG. 4, the receiver stage of the alarm unit comprises a receiver amplifier 3, a discriminator 4, a signal saturation detector 5, a signal loss detector 6, a low frequency amplifier 7, (A), another low frequency amplifier 8, (B), a pulse clarification circuit 9, a comparator 10, and a reference voltage circuit 11 interconnected as shown.

More particularly, receiver amplifier 3 comprises the afore-mentioned receiving transducer RX1, (that is, the electrical strain gauge resistance fixed to the inside of shell SH,) an IC amplifier AMP2, resistances R3, R4 and R5 and capacitors C12 and C13, interconnected and supplied (from network 1, FIG. 2,) with $+V_{cc}$, $-V_{cc}$ and Ov as shown in FIG. 4. Resistance R3 is exchangeable with another resistance (not shown) to set the gain of amplifier 3, which is a band-pass amplifier, the frequency response of which is centred about the oscillation frequency of transmitter 2 of FIG. 3.

Still referring to FIG. 4, the discriminator 4 is supplied with the output from receiver amplifier 3 through a capacitor C14 and comprises a diode D3, resistance R6 and capacitor C15, interconnected as shown. The discriminator 4 produces a DC output which is proportional to the amplitude of the AC output from the receiver amplifier 3. In the event of no disturbance in the area protected by the alarm unit, a constant DC output voltage is produced at the output of the discriminator 4 (at the junction D3 and C15), but if a disturbance occurs in thee protected area, causing an amplitude variation in the AC output from receiver amplifier 3, the DC output of discriminator 4 varies correspondingly. The output of the discriminator 4 is d.c. — coupled into the signal saturation detector 5 and the signal loss detector 6 and is low frequency-coupled via a capacitor C16 into the low frequency amplifier 7 (A).

Still referring to FIG. 4, the signal saturation detector 5 comprises a potential divider formed by resistances R7 and R8 and a diode D4, connected as shown, to supply a portion of the DC output of discriminator 4 to the comparator 10. Normally, the voltage supplied to comparator 10 through diode D4 is below a level required to "trip" the comparator 10. However, if the output voltage of discriminator 4 saturates, due to bombarding of the unit from a separate transmitted signal source, or covering of the unit with reflective material, for example, metallic sheet, or if the receiver amplifier 3 or discriminator 4 fail in such a way as to give a high signal output, disabling the alarm unit, the signal saturation detector 5 supplies a voltage through diode D4 to the comparator 10 which is greater than a voltage supplied to comparator 10 from the reference voltage circuit 11. The effect of this is discussed below.

Still referring to FIG. 4, the signal loss detector 6 is adapted to safeguard against a failure in the transmitter and against the possibility of the receiver amplifier 3 or discriminator 4 failing in such a way as to give a low level or no output. The signal loss detector 6 comprises a resistor R9, diode D5 and capacitor C17, connected as shown. The signal loss detector circuit 6 is a charging circuit, the input to which is the output of the discriminator 4. The output of the signal loss detector 6 is normally a constant voltage level above the non-inverting input trip level of the comparator 10. If a loss of signal occurs at the input to the signal loss detector 6 for a predetermined time, a voltage level which is smaller than the voltage from reference voltage circuit 11 is presented to the non-inverting input of the comparator 10. The effect of this is discussed below.

Still referring to FIG. 4, the low frequency amplifier 7 (A) is capacitor-coupled from the output of the discriminator 4 by capacitor C16, as described above. The low frequency amplifier 7 comprises an IC amplifier AMP 3, resistances RIO through R13, and a capacitor C18, interconnected and supplied from distribution network 1 with $+V_{cc}$, $-V_{cc}$ and Ov as shown in the drawing. The amplifier 7 provides a first stage of amplification of any disturbance signal from the output of the discriminator 4 and is of fixed gain. The frequency response of amplifier 7 is limited so as to reject higher frequency signals that what are required to eventually operate a pulse squaring circuit 13 (FIG. 6). The amplifier 7 has two outputs, one output being capacitor-coupled via a capacitor C19 to the low frequency amplifier 8 (B), the other output being a DC output to terminal T13, for supplying an amplifier failure detector circuit 17 (FIG. 5).

Still referring to FIG. 4, the low frequency amplifier 8 (B) comprises an IC amplifier AMP 4, resistances R14 through R17 and a capacitor C20, interconnected and supplied from network 1 with voltages $+V_{cc}$, $-V_{cc}$ and Ov as shown in the drawing. The input to the low frequency amplifier 8 is capacitor-coupled via capacitor C19 from the output of the low frequency amplifier 7 as described above. The frequency response to the amplifier 8 is similar to that of the amplifier 7. However, the gain of the amplifier 8 can be changed by exchanging resistance R14 for another resistance (not shown), so that the gain of amplifier 8 is suited to the room or other closed environment to be protected by the alarm unit, when the unit is installed. One output from the low frequency amplifier 8 is to terminal T14, to supply the amplifier failure detector 17 (FIG. 5) and a stand-by counter 18 (also FIG. 5), whilst another output from the amplifier 8 is to the pulse clarification circuit 9 (FIG. 4).

Still referring to FIG. 4, the pulse clarification circuit 9 comprises resistances R18 and R19, a capacitor C21, a diode D6 and a zener diode Z1, interconnected as shown. The pulse clarification circuit 9 is a passive differentiator with a signal-to-noise rejecting circuit, to give sufficiently noise-free "disturbance pulses" (in the event of intrusion into the room or environment) to the inverting input of the comparator 10, via zener diode Z1.

Still referring to FIG. 4, the comparator 10 has three trip level inputs, of which two are non-inverting inputs and the third is an inverting input, and also has an input from the reference voltage circuit 11. The comparator 10 comprises an IC amplifier AMP 5 and a resistance R20, connected and supplied from network 1 with $+V_{cc}$ and $-V_{cc}$ as shown in the drawing. The reference voltage circuit 11 comprises resistances R21, R22 and R23, interconnected and supplied with $+V_{cc}$ and Ov as shown in the drawing. Resistances R21, R22 and R23 derive a reference voltage input for comparator 10, supplied thereto through resistance R21.

The signal loss detector 6 being connected to the non-inverting input of the comparator 10, normally causes the comparator 10 to produce a high output level at terminal T15, signifying a non-alarm state. If loss of signal occurs, the signal loss detector 6 output falls and so does the comparator 10 output fall, signifying an alarm state.

The output of the signal saturation detector 5 is connected to the inverting input of comparator 10, so that the normally low output from signal saturation detector 5 to the inverting input of comparator 10 causes a high output from comparator 10 to terminal T15, signifying a non-alarm state. If the output from signal saturation detector 5 rises, due to signal saturation, the output from comparator 10 falls, again signifying an alarm state.

The signal saturation detector 5 and signal loss detector 6 are responsive to signal saturation and signal loss respectively to produce a continuous low "alarm" output from comparator 10.

The pulse clarification circuit 9 output is connected to the inverting input of comparator 10 and normally has a continuous signal level below that of reference voltage circuit 11, so that the output of comparator 10 is normally continuously high, signifying a non-alarm state. When a disturbance is sensed by the alarm unit, the pulse clarification circuit 9 produces a positive pulse output which produces a pulsed (negative-going) output from comparator 10.

Now referring to FIG. 6, the signal processing stage comprises a steady alarm detector 12, the afore-mentioned pulse squarer 13, a reset timer 14, a counting circuit 15, and gating and relay drive circuit 16, interconnected as shown in the drawing.

Referring to FIG. 5, standby circuits of the signal processing stage comprise the afore-mentioned amplifier failure detector 17 and standby counter 18, also a reset timer 19 and a standby gating and relay drive circuit 20, interconnected as shown in the drawing. Terminal T16 of the standby gating and relay drive circuit 20 is connected to a relay circuit 21 (FIG. 6) as shown. The signal processing stage (FIG. 6) also comprises a temperature relay 22 and output contacts RLA/1 of the relay circuit 21.

Referring to FIG. 6, the steady alarm detector 12, comprises a resistance R24, a capacitor C22 and a diode D7, interconnected with each other and to supply voltage $-V_{cc}$ and connected through diode D7 to terminal T15 as shown in the drawing. The steady alarm detector is in the form of a discharge circuit with a predetermined decay time which will disregard the pulse alarm outputs of the comparator 10. If the comparator 10 output is in a steady alarm state, that is, low output voltage, due to signal loss, signal saturation or failure of comparator 10, the steady alarm detector 12 supplies an alarm signal after a predetermined time to the gating and relay drive circuit 16 from the junction of D7, C22 and R24.

The pulse squarer 13 comprises an IC amplifier AMP 6, resistances R25 through R29, capacitors C23 and C24 and diode D8, interconnected and supplied from network 1 with $+V_{cc}$, $-V_{cc}$ and Ov as shown in the drawing. The output of the pulse squarer 13 is a constant amplitude, constant width pulse. The pulse width (or duration) is determined by resistance R28 and capacitants C24. The trigger input to the pulse squarer 13 is the pulsed alarm output of the comparator 10 (FIG. 4.) The pulse squarer 13 disregards the steady state alarm output of comparator 10. The output of pulse squarer 13 is d.c. — coupled to the reset timer 14 and the counting circuit 15, as shown.

Still referring to FIG. 6, the reset timer 14 comprises an IC amplifier AMP 7, an NPN-type transistor Q3, resistances R30 through R35, diodes D9 and D10 and capacitors C25 and C26, interconnected and supplied from network 1 with $+V_{cc}$, $-V_{cc}$ and Ov voltages as shown in the drawing. The reset timer 14 is a monostable multivibrator circuit with a predetermined timing cycle. The timing cycle is initiated by the trailing edge of the first alarm output of the pulse squarer 13 and will ignore subsequent outputs of the pulse squarer circuit 13 until the predetermined timing cycle is complete. The leading edge of the reset timer 14 output enables the counting circuit 15 to accept the output pulses of the pulse squarer 13, the reset timer 14 being connected to the counting circuit 15 from the collector of transistor Q3. After the predetermined time, the output of the reset timer 14 will reset the counting circuit 15 to zero.

Still referring to FIG. 6, the counting circuit 15 comprises resistances R36 and R37, diode D11 and capacitor C27, interconnected as shown in the drawing. The counting circuit 15 is a pulse counting circuit with the facility of being reset during its counting cycle to zero by the reset timer 14, as briefly described above. The total number of pulses required to give an alarm output during the timing cycle of the reset timer 14 is determined by the values of resistances R36 and R37, which are selectively in parallel to give a selected resistance value in combination.

If the pulse count fails to reach the predetermined count required to give an alarm during the timing cycle of the reset timer 14, the counting circuit will be reset to zero. This facility is provided to eliminate false alarms due to irregular disturbances within the protected area, for example, sonic booms, falling objects, structure settlement etc.

If the predetermined count is exceeded during the timing cycle of the reset timer 14, the counting circuit 15 gives an alarm output from the junction of resistances R36 and R37 and capacitor C27. This alarm output is d.c. — coupled to the gating and relay drive circuit 16.

Still referring to FIG. 6, the gating and relay drive circuit 16 comprises an IC amplifier AMP 8, an NPN — type transistor Q4, resistances R38 through R41, and capacitors C28 and C29, interconnected and supplied from network 1 with $+V_{cc}$, and $+V_{cc}$ as shown in the drawing. The gating and relay drive circuit 16 forms a monostable multivibrator, the triggering of which can be achieved by either the alarm output of the counting circuit 15 or the steady state alarm detector circuit 12.

Upon energisation, the output of the gating and relay drive circuit 16 is set to a high output level by capacitor C28 and resistor R40, which together form a timing circuit. Hence transistor Q4 is normally conducting in the non-alarm state.

At this stage, still referring to FIG. 6, it is convenient to mention that the relay circuit 21 comprises a relay coil RLA and a resistance R42, connected as shown to $-V_{cc}$ (from network 1) and through transistor Q4 of the gating and relay drive circuit 16 to $+V_{cc}$. Since transistor Q4 is normally conducting in the non-alarm state, relay RLA is normally energised, closing contacts RLA/1, in the non-alarm state.

If an alarm output is received from the counting circuit 15, the output of the gating and relay drive circuit 16 falls, transistor Q4 ceasing to conduct, so that relay coil RLA is de-energised, opening contacts RLA/1. The relay RLA remains de-energised for a period determined by the timing circuit C28 and R40 of gating and relay drive circuit 16, after which transistor Q4 again conducts to re-energise relay coil RLA and again close contacts RLA/1. Hence, the alarm sequence can be repeated without the need for manual reset.

If an alarm from the steady state alarm detector 12 is received, the output of the gating and relay drive circuit 16 falls, transistor 16 ceasing to conduct, and remains in this state continuously while the alarm is present. This ensures that any tampering with the alarm unit or that certain function failures in the preceding stages will be indicated by the failure of the relay RLA to reset.

Referring now to FIG. 5, the amplifier failure detector 17 comprises an IC amplifier AMP 9, resistances R43 through R47, diodes D12 through D15 and capacitors C30 and C31, interconnected and supplied from network 1 with $+V_{cc}$, and $-V_{cc}$ and connected to terminals T13 and T14 and to the standby gating and relay drive circuit 20 as shown in the drawing. The amplifier failure detector circuit 17 is adapted to safeguard against failure of either of the two low frequency amplifiers 7 (A) and 8 (B), whether the failure causes the amplifier 7 or 8 to go into a saturated high level or a saturated low level. More particularly, the circuit 17 is a so-called "window discriminator" with delay circuitry (formed by resistance R43 in parallel with capacitor C30 and by resistance R46 in parallel with capacitor C31) to disregard the pulsed inputs from amplifiers 7 and 8. If either or both of the outputs from low frequency amplifiers 7 and 8 is or are continually higher or lower than the set points of the window discriminator, the discriminator, (that is, detector 17,) will give an alarm output into the standby gating and relay drive circuit 20, through resistance R47.

Still referring to FIG. 5, the standby counter 18 comprises an IC amplifier AMP 10, resistances R48 through R54, capacitors C32 through C34, and diodes D16 and D17, interconnected and supplied from network 1 with $+V_{cc}$, $-V_{cc}$ and Ov and connected to terminal T14 and to reset timer 19 as shown in the drawing. The standby counter 18 is similar to the counting circuit 15 but is adapted to provide a numerically greater pulse count before giving an alarm output to the standby gating and relay drive circuit 20. The function of the standby counter 18 is to override the counting circuitry consisting of pulse squarer 13, reset timer 14 and counting circuit 15 in the event of any failure in either of the three last-mentioned circuits.

Still referring to FIG. 5, the reset timer 19 comprises an IC amplifier AMP 11, an NPN — type transistor Q5, resistances R55 through R60, capacitors C35 and C36 and diodes D18 and D19, interconnected and supplied from network 1 with $+V_{cc}$, $-V_{cc}$ and Ov and connected to the standby counter 18 and the standby gating and relay drive circuit 20 as shown in the drawing. The reset timer 19 is identical to the reset timer 14 and serves the same circuit function.

Still referring to FIG. 5, the standby gating and relay drive circuit 20 comprises an IC amplifier AMP 12, an NPN — type transistor Q6, resistances R61 through R65 and a capacitor C37, interconnected and supplied from network 1 with $+V_{cc}$, $-V_{cc}$ and Ov and connected to amplifier failure detector 17 and to reset timer 19 and to terminal T16 as shown in the drawing. The standby gating and relay drive circuit 20 is identical to the gating and relay drive circuit 16 and serves the purpose of overriding the circuit 16 in the event of failure of circuit 16 or of any of the pulse squarer 13, reset timer 14 and counting circuit 15. Transistor Q6 of the standby gating and relay drive circuit 20 is connected via terminal T16 to relay coil RLA of relay circuit 21 (FIG. 6). Accordingly, in the event that the standby gating and relay drive circuit 20 is caused to override the gating and relay drive circuit 16, conduction of transistor Q6 short-circuits the relay coil RLA to the $-V_{cc}$ supply irrespective of whether or not transistor Q4 is conducting.

The relay contacts RLA/1 are electrically completely isolated from the remainder of the circuitry described above and are connected as shown schematically to an ALARM, preferably a conventional audible alarm which is of a known type to give a warning when contacts RLA/1 open and to remain silent so long as contacts RLA/1 are closed.

The alarm unit also comprises a temperature-sensitive relay 22 and the ALARM is connected in series not only with contacts RLA/1 of relay RLA but also with contacts of temperature relay 22, so that an alarm is sounded when the contacts of either relay RLA or temperature relay 22 open. The temperature relay 22 is adapted for its contacts to open, (for example, by means of a bimetallic strip,) in response to a high temperature caused by fire.

As mentioned earlier, the alarm itself is external to the shell SH, unlike the other circuitry, so that the unit without the alarm should more properly be described as a surveillance unit, rather than an alarm unit.

Figure 7:
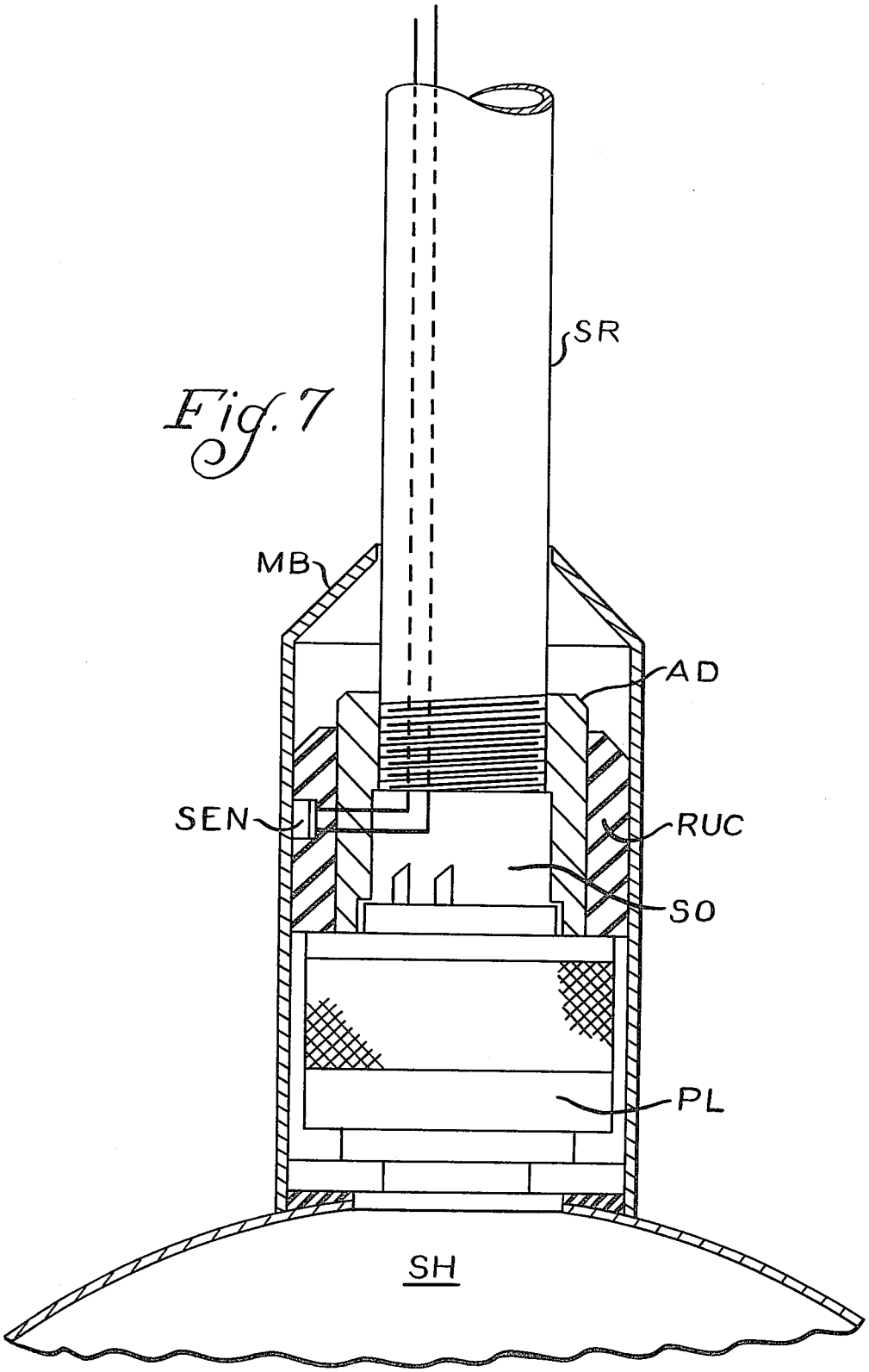
FIG. 7 is a section through parts of the shell and support rod of a modified surveillance unit.

Referring to FIG. 7, there is shown part of a modified surveillance unit in which the shell SH is fitted with an electrical plug PL and in which the (tubular) support rod SR is fitted with an electrical socket SO mating with the plug PL, the plug PL and socket SO being multi-path of military quality. A metal adaptor AD joins the support rod SR to the screw-thread of the socket SO. A rubber collar RUC is fitted over the adaptor AD. A metal "boot" MB covers the plug and socket, fitting closely at its upper end around the support rod and at its lower end onto the shell SH. It is necessary to remove the metal boot MB in order to obtain access to the plug PL, socket SO and adaptor AD. An electrical sensor SEN is embedded in the rubber collar RUC adjacent the metal boot MB, for sensing any attempt to remove the metal boot MB, and is wired through the socket SO and support rod SR to the alarm, not shown, to operate the alarm in the event of any attempt to remove the metal boot MB.

I claim:

1. An omnidirectional ultrasonic surveillance unit for used in a closed environment and comprising:

a substantially closed shell forming a housing;

means for supporting the housing away from any ceiling, walls and floor of the closed environment so that there is open space substantially all around the housing;

means for radiating oscillatory energy at an ultrasonic frequency in substantially all directions from said surveillance unit so that the open space all around the housing is filled with sound waves;

said housing being adapted to vibrate in response to reflected sound waves impinging thereon;

receiver transducer means connected to the inside of said housing for sensing vibration thereof and for generating an oscillatory electrical signal in response thereto; and electrical circuitry inside the housing, said electrical circuitry including:

means for generating said oscillatory energy inside the housing and for driving said radiating means;

means for amplifying the oscillatory electrical signal generated by said receiver transducer means;

discriminator means for producing a variable DC signal responsive to amplitude variations in the amplified oscillatory electrical signal from the amplifying means;

low frequency amplifier means for amplifying low frequency signals from said discriminator means; and means responsive to the output from said low frequency amplifier means for producing an electrical alarm-operating signal.

2. A surveillance unit as defined in claim 1 wherein said alarm-operating signal-producing means comprises:

means for producing shaped pulses in response to said low frequency amplifying means;

means responsive to a first pulse from said pulse-producing means to commence timing a counting period;

means for counting the number of pulses from said pulse-producing means during the counting period;

and means for producing said alarm-operating signal only if the number of pulses counted during the counting period by said counting means reaches a predetermined minimum number.

3. A surveillance unit as defined in claim 1 wherein said electrical circuitry includes means responsive to loss of signal from said discriminator means for producing said alarm-operating signal and means responsive to signal saturation from said discriminator means for producing said alarm-operating signal.

4. A surveillance unit as defined in claim 1 wherein said housing supporting means comprises a support rod joined to and extending away from said shell.

5. A surveillance unit as defined in claim 1 wherein the shell is formed with at least one port-hole and wherein said radiating means comprises at least one respective sonar transducer located in said at least one port-hole.

6. A surveillance unit as defined in claim 1 wherein said shell is substantially spherical.

7. A surveillance unit as defined in claim 2 wherein said electrical circuitry includes means responsive to loss of signal from said discriminator means for producing said alarm-operating signal and means responsive to signal saturation from said discriminator means for producing said alarm-operating signal;

wherein said housing supporting means comprises a support rod joined to and extending away from said shell;

wherein the shell is formed with at least one port-hole and wherein said radiating means comprises at least one respective sonar transducer located in said at least one port-hole; and wherein said shell is substantially spherical.

* * * * *